US011383539B2

(12) United States Patent
Kuwabara

(10) Patent No.: US 11,383,539 B2
(45) Date of Patent: Jul. 12, 2022

(54) UNIT ATTACHING/DETACHING STRUCTURE AND IMAGE FORMING SYSTEM

(71) Applicant: FUJIFILM Business Innovation Corp., Tokyo (JP)

(72) Inventor: Daisuke Kuwabara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 380 days.

(21) Appl. No.: 16/534,517

(22) Filed: Aug. 7, 2019

(65) Prior Publication Data

US 2020/0238737 A1 Jul. 30, 2020

(30) Foreign Application Priority Data

Jan. 25, 2019 (JP) ..... JP2019-011558

(51) Int. Cl.

| | |
|---|---|
| ***B65H 31/22*** | (2006.01) |
| ***B65H 31/24*** | (2006.01) |
| ***B41J 13/10*** | (2006.01) |
| ***B65H 31/34*** | (2006.01) |

(52) U.S. Cl.

CPC ..... *B41J 13/106* (2013.01); *B65H 31/34* (2013.01); *B65H 2404/5511* (2013.01); *B65H 2404/74* (2013.01)

(58) Field of Classification Search

CPC ..... B65H 31/22; B65H 31/24; B65H 31/34; B65H 2404/5511; B65H 2404/74; B65H 2553/61; B65H 2553/612; G03G 15/6552; B41J 13/106

See application file for complete search history.

(56) References Cited

FOREIGN PATENT DOCUMENTS

| | | | |
|---|---|---|---|
| JP | 2006290540 A | * | 10/2006 |
| JP | 2014-194506 A | | 10/2014 |
| JP | 5871849 B2 | | 3/2016 |

* cited by examiner

*Primary Examiner* — Luis A Gonzalez
(74) *Attorney, Agent, or Firm* — Sughrue Mion, PLLC

(57) ABSTRACT

A unit attaching detaching structure includes: a unit that is attachable to and detachable from an apparatus main body; a displacement portion that is provided on the apparatus main body and is displaceable to one side and another side; a detection unit that detects attachment of the unit when the displacement portion is displaced from the another side to the one side; a connecting portion that is separated from the detection unit in a direction intersecting with a direction of attaching/detaching of the unit, and is connected to the displacement portion so as to displace the displacement portion; a movement portion that is provided on the unit and displaces the displacement portion by moving the connecting portion when the unit is attached to the apparatus main body; and a returning unit that returns the displacement portion when the unit is detached from the apparatus main body.

6 Claims, 9 Drawing Sheets

UNIT ATTACHING/DETACHING STRUCTURE AND IMAGE FORMING SYSTEM

CROSS-REFERENCE TO RELATED APPLICATIONS

This application is based on and claims priority under 35 USC 119 from Japanese Patent Application No. 2019-011558 filed Jan. 25, 2019.

BACKGROUND

(i) Technical Field

The present disclosure relates to a unit attaching/detaching structure and an image forming system.

(ii) Related Art

In a grounding structure of a unit disclosed in JP-A-2014-194506, the unit is detachable while preventing a ground spring interposed between the two units from being projected.

In the related art, in a configuration in which a unit attachable to and detachable from the apparatus main body is provided, the apparatus main body is provided with a displacement portion that is displaced by attaching the detached unit on the apparatus main body, and a detection unit that detects attachment of the unit with respect to the apparatus main body by displacing the displacement portion. Further, when the unit is attached to the apparatus main body, the unit is provided with a movement portion that directly comes into contact with the displacement portion to displace the displacement portion.

Thus, when the unit is brought close to the apparatus main body in an attempt to attach the unit on the apparatus main body, if a position of the unit deviates from a target position, the movement portion of the unit may come into contact with the detection unit, which may cause damage to the detection unit.

SUMMARY

Aspects of non-limiting embodiments of the present disclosure relate to preventing damage to a detection unit when a unit is attached to an apparatus main body in contrast to case where a movement portion of the unit directly displaces a displacement portion of the apparatus main body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a unit attaching/detaching structure, including: a unit that is attachable to and detachable from an apparatus main body; a displacement portion that is provided on the apparatus main body and is displaceable to one side and another side; a detection unit that detects attachment of the unit when the displacement portion is displaced from the another side to the one side; a connecting portion that is separated from the detection unit in a direction intersecting with a direction of attaching/detaching of the unit, and is connected to the displacement portion so as to displace the displacement portion to be moved; a movement portion that is provided on the unit and displaces the displacement portion from the another side to the one side by moving the connecting portion when the unit is attached to the apparatus main body; and a returning unit that returns the displacement portion from the one side to the another side when the unit is detached from the apparatus main body.

BRIEF DESCRIPTION OF THE DRAWINGS

Exemplary embodiments of the present invention will be described in detail based on the following figures, wherein.

DETAILED DESCRIPTION

Figure 1:
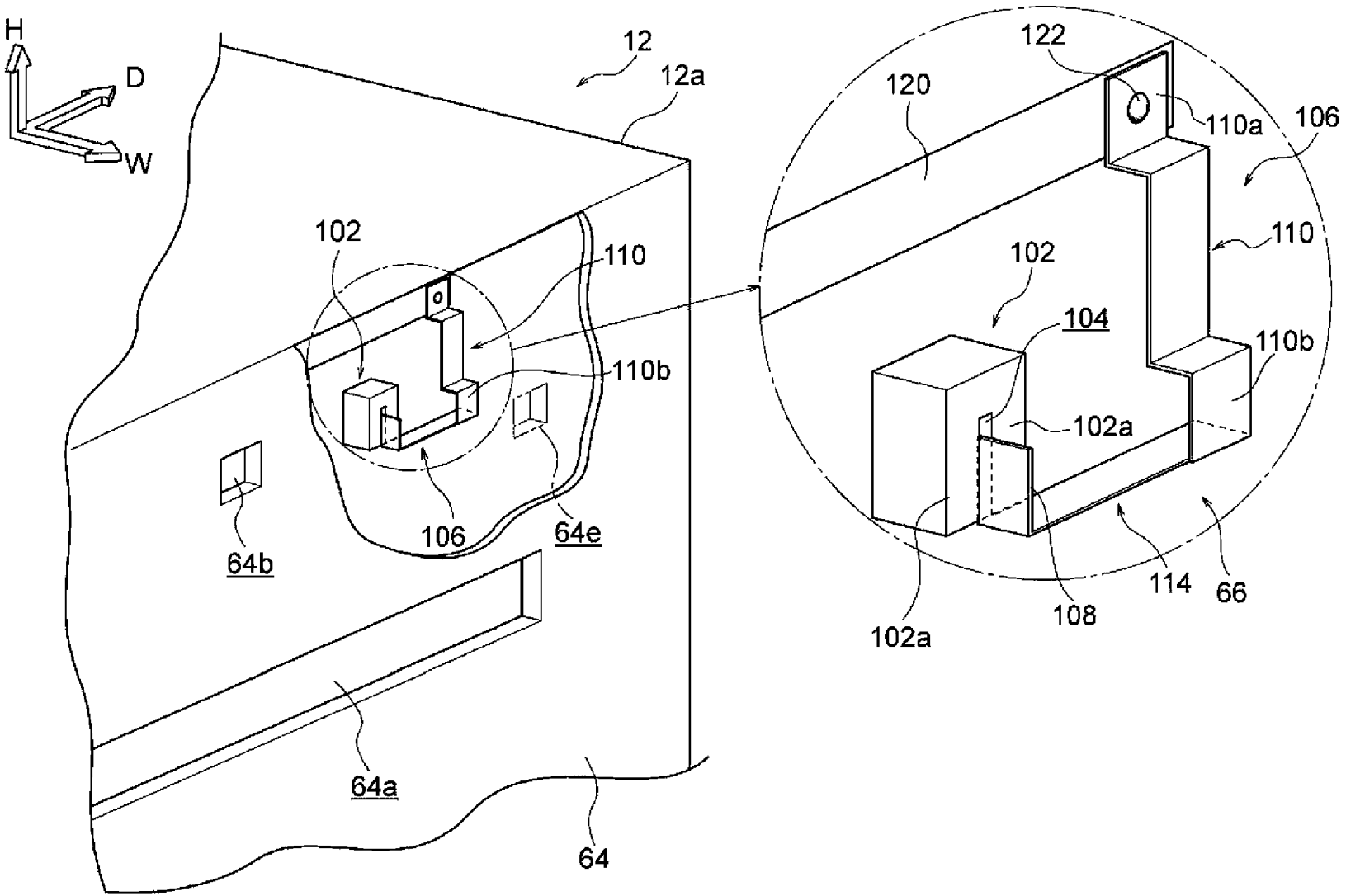
FIG. 1 is a perspective view illustrating a detection unit and a cantilevered portion provided in an apparatus main body of a unit attaching/detaching structure according to an exemplary embodiment of the present disclosure.

An example of a unit attaching/detaching structure and an image forming system according to the exemplary embodiment of the present disclosure will be described with reference to FIGS. 1 to 9. Note that, in the drawings, an arrow H indicates a vertical direction of the apparatus (=vertical direction), an arrow W indicates an apparatus width direction (an example of a horizontal direction), and an arrow D indicates an apparatus depth direction (another example of the horizontal direction).

Overall Configuration

Figure 8:
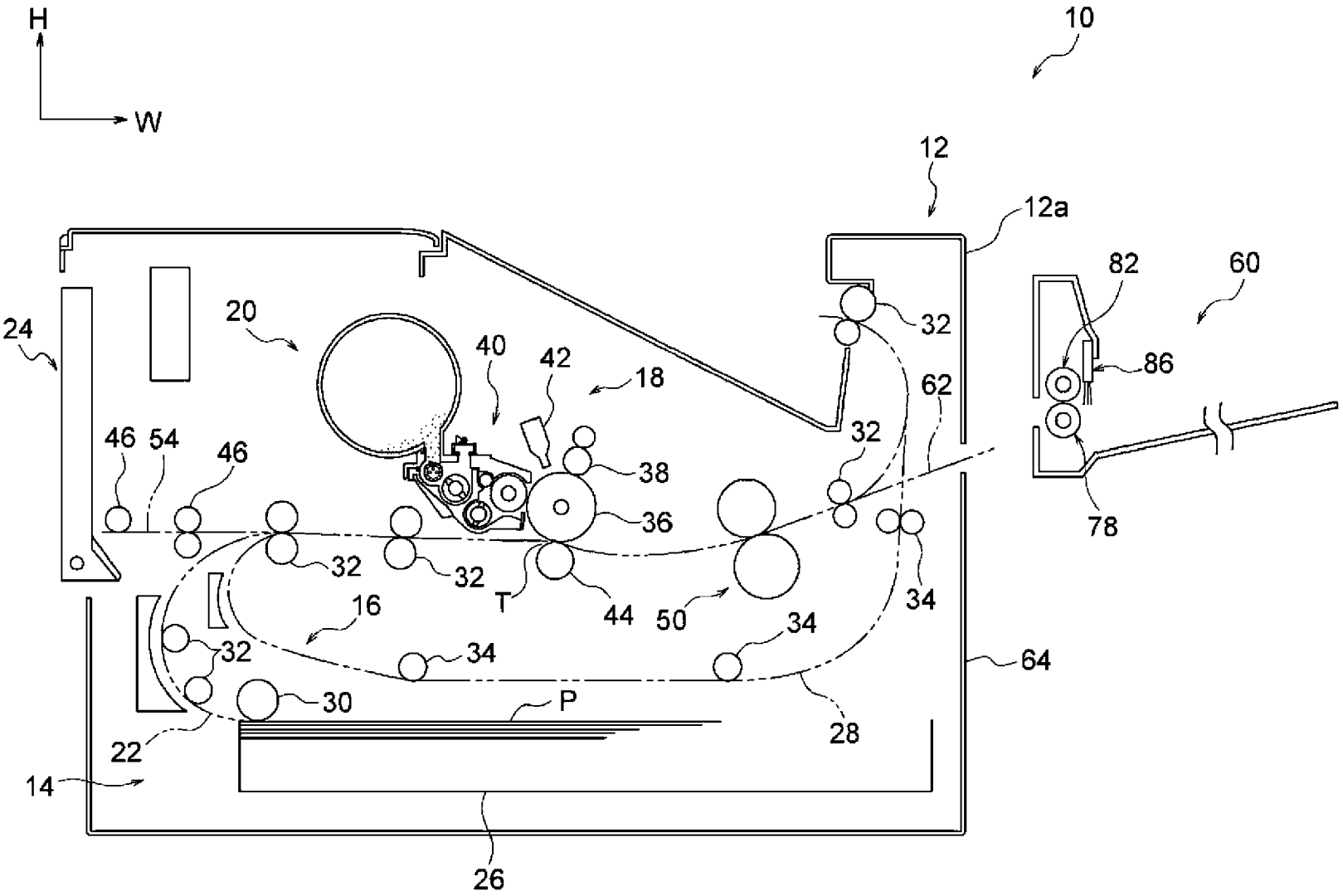
FIG. 8 is a configuration diagram illustrating an image forming system according to an exemplary embodiment of the present disclosure.
Figure 9:
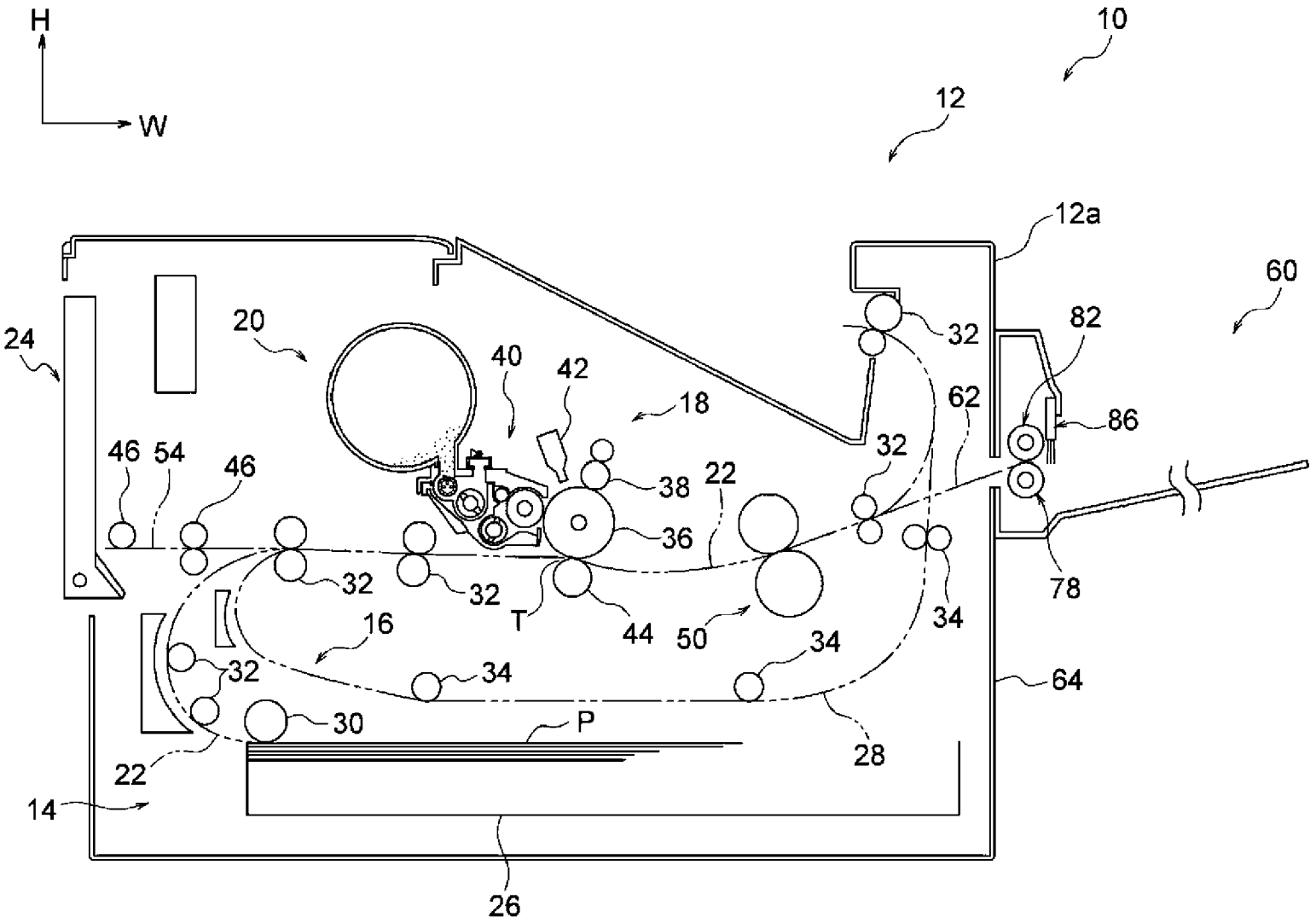
FIG. 9 is a configuration diagram illustrating an image forming system according to an exemplary embodiment of the present disclosure.

An image forming system 10 according to the exemplary embodiment is provided with, as illustrated in FIGS. 8 and 9, an image forming apparatus 12, an apparatus main body 12*a* of an output unit 60 that is attachable to and detachable from the image forming apparatus 12.

As illustrated in FIGS. 8 and 9, in the image forming apparatus 12, an accommodating portion 14 in which a sheet member P as a recording medium is accommodated, a transport unit 16 that transports the sheet member P accommodated in the accommodating portion 14, and an image forming unit 20 that performs image-forming on the sheet member P transported from the accommodating portion 14 by the transport unit 16 are provided in this order, from the lower side to the upper side in vertical direction (=direction of arrow H). Further, the image forming apparatus 12 is provided with a manual feed portion 24 in which the sheet member P can be supplied from the outside of the apparatus main body 12*a*.

Note that, a side plate 64 being in contact with the output unit 60 attached to the apparatus main body 12*a*, and the like will be specifically described later.

Accommodating Portion 14

The accommodating portion 14 is provided with an accommodating member 26 that can be pulled out from the apparatus main body 12*a* of the image forming apparatus 12 in an apparatus width direction (=left direction in the drawings), and the sheet members P are stacked on the accommodating member 26. The accommodating portion 14 is further provided with a feeding roll 30 for feeding the sheet member P stacked on the accommodating member 26 to a transport path 22 constituting the transport unit 16.

Transport Unit 16

The transport unit 16 is provided with plural transport rolls 32 for transporting the sheet member P along the predetermined transport path 22, and a transport roll 34 for transporting the sheet member P along a reversed path 28 through which the sheet member P passes to reverse the front and back of the sheet member P.

In addition, the transport unit 16 is provided with a transport roll 46 for transporting the sheet member P along a supply path 54 through which the sheet member P supplied from a manual feed portion 24 passes.

In the transport path 22, a part on the upstream side and a part on the downstream side in the transport direction of the sheet member P are formed into a U shape. That is, the sheet member P is folded in the transport direction in the U shape and then output to the outside of the apparatus main body 12*a*.

In addition, the transport unit 16 is provided with an output path 62 which is branched from the part on the downstream side of the transport direction of the sheet member P in the transport path 22, and outputs the sheet member P to the outside of the apparatus main body 12*a* without folding the sheet member P into the U shape.

Image Forming Unit 20

The image forming unit 20 includes an image forming unit 18 that forms a black image.

The image forming unit 18 is provided with an image holding member 36, a charging roll 38 for charging the surface of the image holding member 36, and an exposure device 42 for irradiating the charged image holding member 36 with exposure light. Further, the image forming unit 20 is provided with a developing machine 40 for developing an electrostatic latent image formed by exposing the image holding member 36 charged by the exposure device 42 to visualize the electrostatic latent image as a toner image.

Further, the image forming unit 20 is provided with a transfer roll 44 for transferring the toner image formed by the image forming unit 18 to the sheet member P at a transfer position T where the image is transferred to the sheet member P, and a fixing device 50 that fixes the toner image to the sheet member P by heating and pressing the sheet member P.

Output Unit 60

The output unit 60 is attachable to and detachable from the apparatus main body 12*a*, Then, the sheet member P transported along the output path 62 is output to the output unit 60.

The output unit 60 and a detection mechanism 66 for detecting that the output unit 60 is attached to the apparatus main body 12*a* will be described in detail later.

Action of Image Forming Apparatus

The image forming apparatus 12 forms an image as follows.

First, the charging roll 38 to which a voltage is applied comes into contact with the surface of the image holding member 36 to negatively charge the surface of the image holding member 36 uniformly at a predetermined potential. Subsequently, the exposure device 42 irradiates the charged surface of the image holding member 36 with exposure light to form an electrostatic latent image based on data input from the outside.

With this, the electrostatic latent image corresponding to the data is formed on the surface of the image holding member 36. Further, the developing machine 40 develops and visualizes the electrostatic latent image as a toner image.

Then, the sheet member P fed from the accommodating member 26 to the transport path 22 by the feeding roll 30 is transported to the transfer position T. At the transfer position T, the sheet member P is sandwiched and transported by the image holding member 36 and the transfer roll 44, thereby the toner image on the surface of the image holding member 36 is transferred to the sheet member P.

The toner image transferred to the sheet member P is fixed to the sheet member P by the fixing device 50. Then, the sheet member P on which the toner image is fixed is transported along the transport path 22, folded back in a U-shape, and output to the upper part of the apparatus main body 12*a*.

On the other hand, when the sheet member P on which the toner image is fixed by the fixing device 50 is output to the output unit 60, the sheet member P on which the toner image is fixed is transported along the output path 62 branched from the transport path 22, and is output to the output unit 60 without being folded back in a U-shape.

Configuration of Main Components

Next, the side plate 64 of the apparatus main body 12*a*, the output unit 60, and the detection mechanism 66 (refer to FIG. 1) for detecting that the output unit 60 is attached to the apparatus main body 12*a* will be described. The output unit 60 is an example of a unit.

Side Plate 64 of Apparatus Main Body 12*a*

As illustrated in FIGS. 8 and 9, the side plate 64 is disposed on the downstream side of the transport direction in which the plate surface facing the apparatus width direction and the sheet member P having the toner image transferred at the transfer position T is transported.

Figure 6:
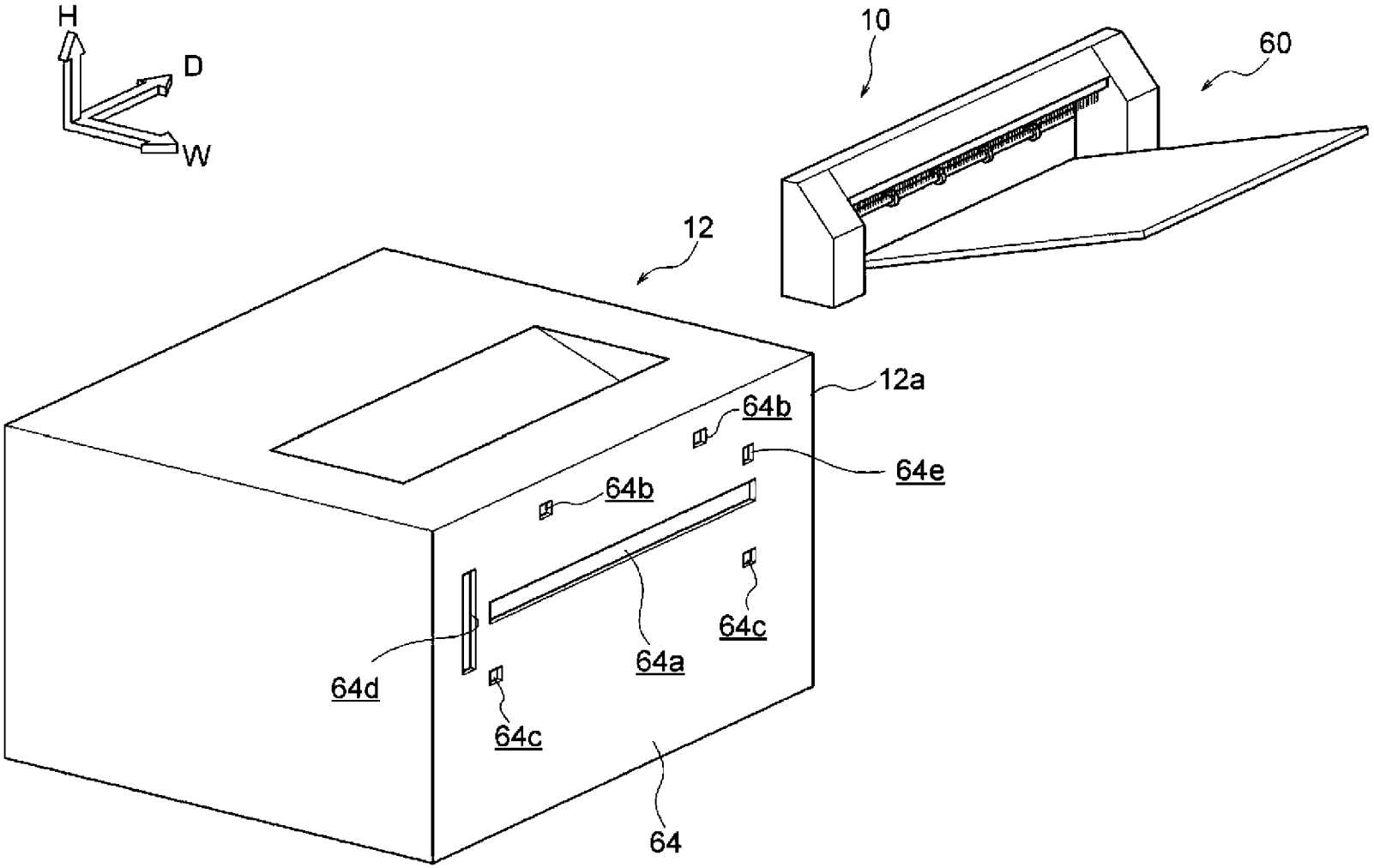
FIG. 6 is a perspective view illustrating an apparatus main body of the unit attaching/detaching structure according to the exemplary embodiment of the present disclosure.

As illustrated in FIG. 6, the side plate 64 is provided with an output hole 64*a* through which the sheet member P output from the apparatus main body 12*a* passes, and positioning recessed portions 64*b* and 64*c* for positioning the output unit 60 with respect to the apparatus main body 12*a*. The side plate 64 is further provided with an insertion hole 64*d* for inserting a part of a transmission gear 98 described later into the apparatus main body 12*a*, and a detection hole 64*e* into which a detection convex portion 72*e* described later is inserted.

The output hole 64*a* is formed in a part on the center side in the vertical direction of the side plate 64. Further, the output hole 64*a* is formed into a rectangular shape extending in the apparatus depth direction as viewed from the apparatus width direction.

The positioning recessed portions 64*b* are formed in a pair separately in the apparatus depth direction, at a part on the upper side of the output hole 64*a* in the side plate 64.

Further, each positioning recessed portion 64*b* is rectangular when viewed from the apparatus width direction.

The positioning recessed portions 64*c* are formed in a pair separately in the apparatus depth direction, at a part on the lower side of the output hole 64*a* in the side plate 64. Further, each positioning recessed portion 64*c* is rectangular when viewed from the apparatus width direction.

The insertion hole 64*d* is formed in a part on the front side in the apparatus depth direction with respect to the output hole 64*a* in the side plate 64. Further, the insertion hole 64*d* is formed into a rectangular shape extending in the vertical direction as viewed from the apparatus width direction.

The detection hole 64*e* is formed in a part on the back side in the apparatus depth direction of the side plate 64 between the output hole 64*a* and the positioning recessed portion 64*b* in the vertical direction. Further, the detection hole 64*e* is rectangular when viewed from the apparatus width direction.

Output Unit 60

Figure 7:
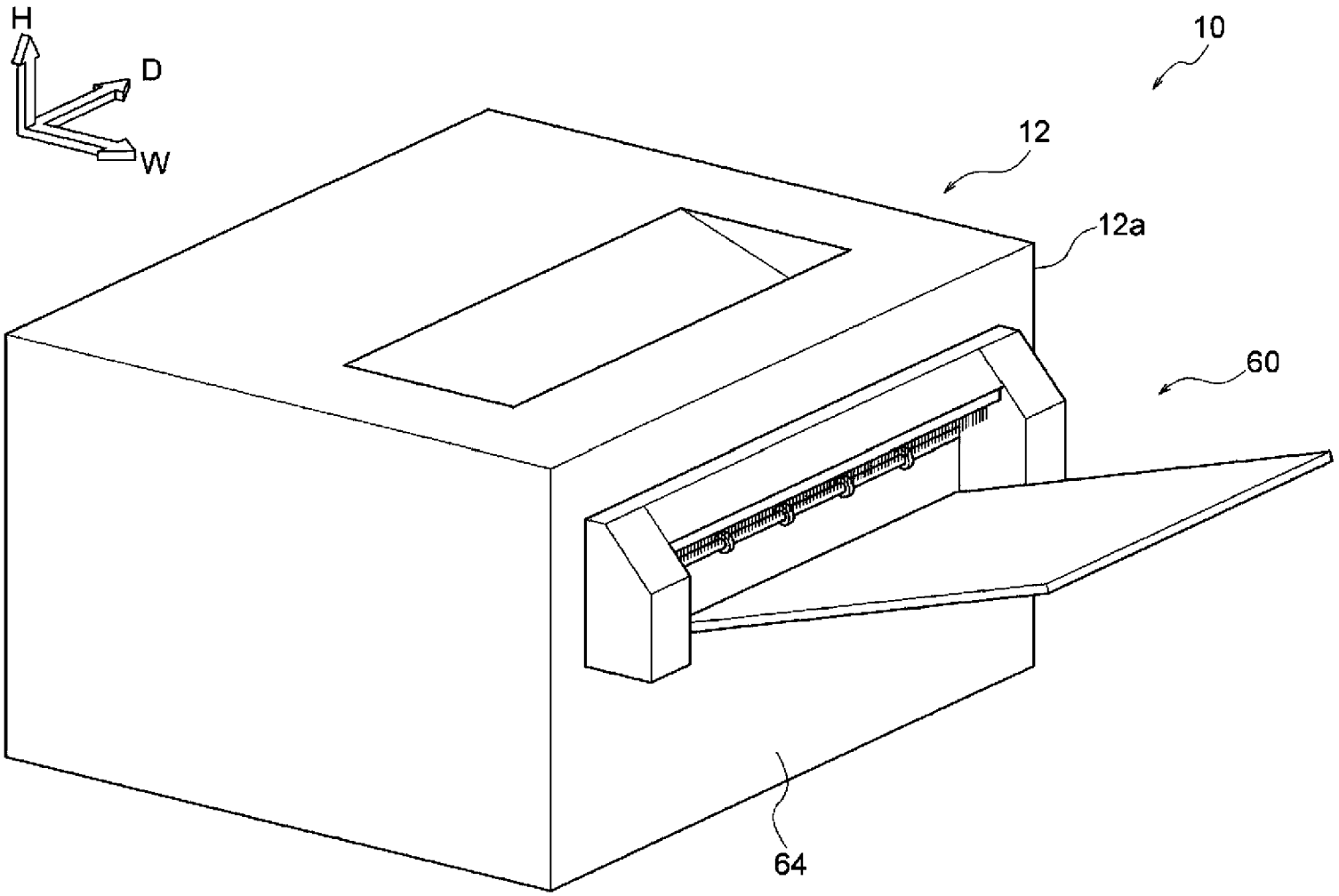
FIG. 7 is a perspective view illustrating an image forming system according to an exemplary embodiment of the present disclosure.

The output unit 60 is a unit that can be selectively used by the user, and as illustrated in FIGS. 6 and 7, is attachable to and detachable from the apparatus main body 12*a*, and is in contact with the side plate 64 of the apparatus main body 12*a* in a state of being attached to the apparatus main body 12*a*, Note that the state in which the output unit 60 is attached to the apparatus main body 12*a*" means a state that the sheet member P can be output from the apparatus main body 12*a* to the output unit 60 when the user designates output of the sheet member P to the output unit 60.

Figure 5:
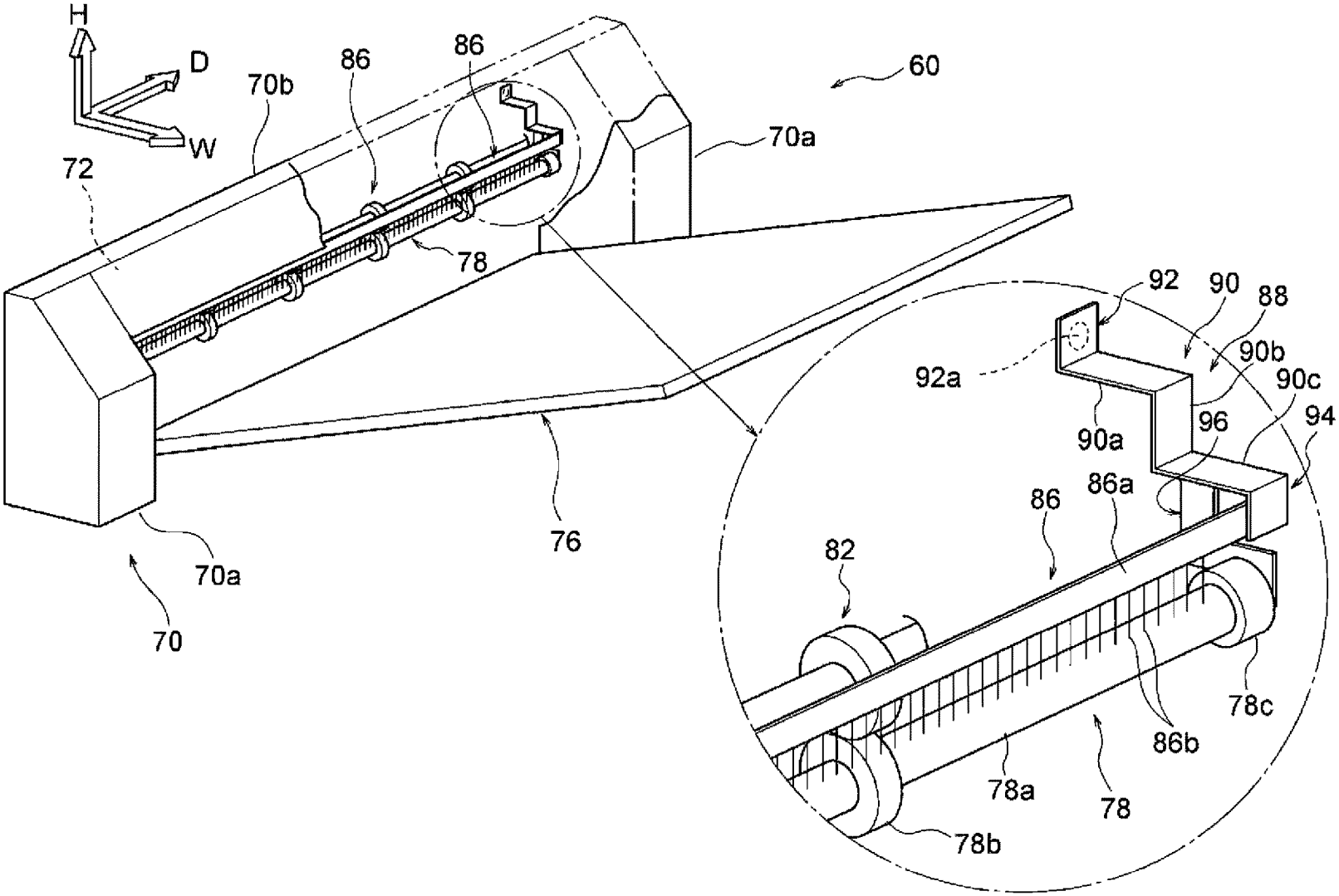
FIG. 5 is a perspective view illustrating the output unit of the unit attaching/detaching structure according to the exemplary embodiment of the present disclosure.

As illustrated in FIG. 5, the output unit 60 is provided with a unit main body portion 70 in contact with the side plate 64 (refer to FIG. 7) of the apparatus main body 12*a*, and an output plate 76 on which the sheet member P output from the apparatus main body 12*a* is placed. Further, output unit 60 is provided with an output roll 78, a pressing roll 82, a charge removal brush 86, and a charge removal plate 88. The output roll 78 is an example of a transport unit, Unit Main Body Portion 70

Figure 4:
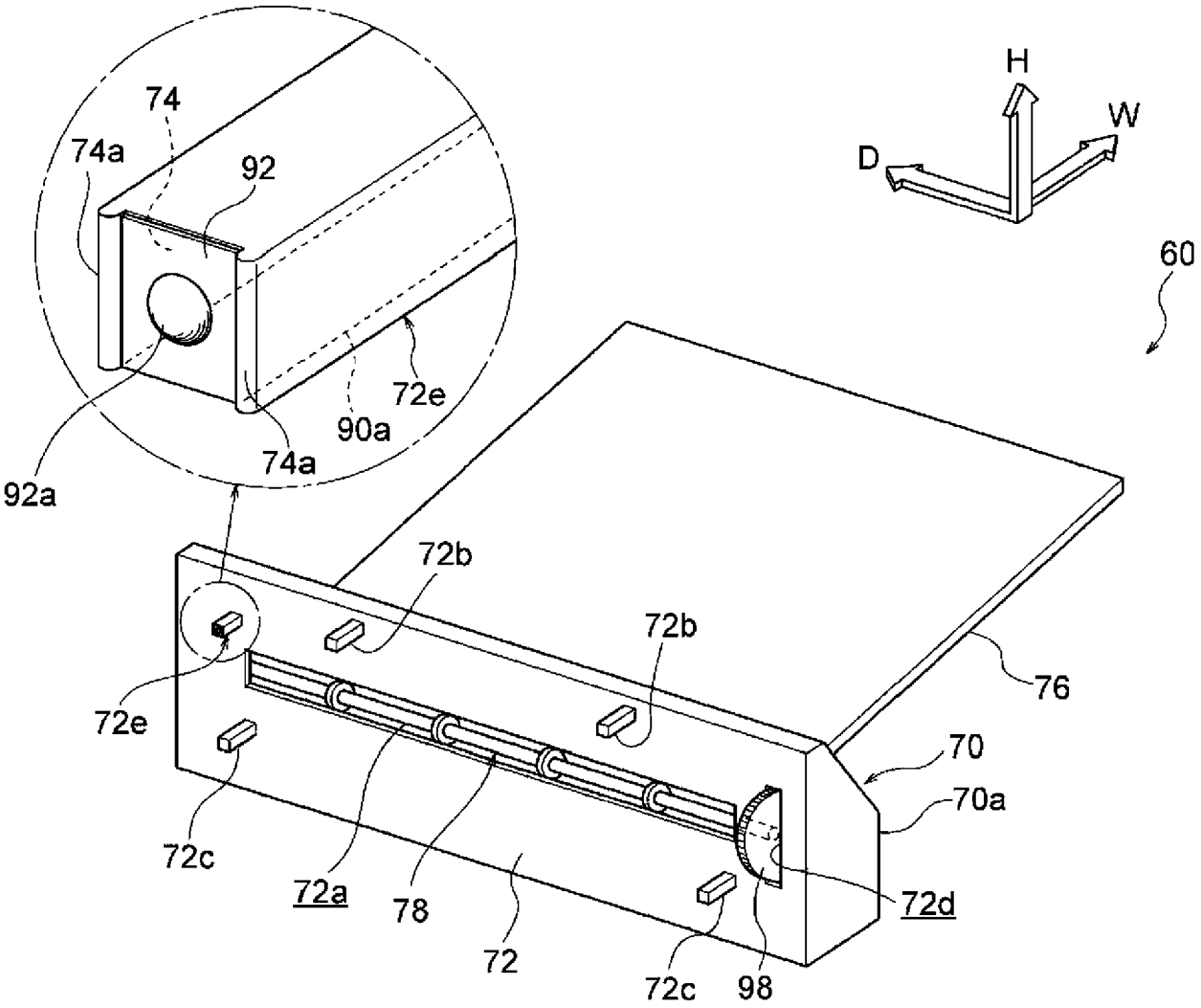
FIG. 4 is a perspective view illustrating the output unit of the unit attaching/detaching structure according to the exemplary embodiment of the present disclosure.

As illustrated in FIGS. 4 and 5, the unit main body portion 70 extends in the apparatus depth direction, and has a hollow inside. Further, the unit main body portion 70 is provided with a pair of protruding portions 70*a* protruding in the apparatus width direction from both end portions of the unit main body portion 70 in the apparatus depth direction, and an intermediate portion 70*h* sandwiched between the pair of the protruding portions 70*a*. In addition, on the apparatus main body 12*a* side of the pair of protruding portions 70*a* and the intermediate portion 70*b*, a facing plate 72 which constitutes the unit main body portion 70 and faces the side plate 64 of the apparatus main body 12*a* is disposed.

As illustrated in FIG. 4, the facing plate 72 is provided with a passage hole 72*a* through which the sheet member P output from the apparatus main body 12*a* passes, and a pair of positioning convex portions 72*b* and a pair of positioning convex portions 72*c* for positioning the output unit 60 with respect to the apparatus main body 12*a*. Further, the facing plate 72 is provided with an exposure hole 72*d* for exposing a portion of a transmission gear 98 described later to the outside, and a detection convex portion 72*e* inserted in the detection hole 64*e* (refer to FIG. 6).

The detection convex portion 72*e* has a rectangular cross section, and a rectangular end surface 74 is formed at the end of the detection convex portion 72*e*. Further, at both end portions of the end surface 74 in the apparatus depth direction, a pair of protruding portions 74*a* extending in the vertical direction is formed.

In this configuration, by moving the output unit 60 detached from the apparatus main body 12*a* in the apparatus width direction, the pair of positioning convex portions 72*h* of the facing plate 72 are respectively inserted into the recessed portions 64*b* (refer to FIG. 6) of the side plate 64. Further, the pair of positioning convex portions 72*c* of the facing plate 72 are respectively inserted into the recessed portions 64*c* (refer to FIG. 6) of the side plate 64. As a result, the output unit 60 is positioned with respect to the apparatus main body 12*a*, and the output unit 60 is attached to the apparatus main body 12*a* (hereinafter, referred to as "attached state of the output unit 60"). The apparatus width direction is an example of the attaching/detaching direction of the unit.

Further, in the attached state of the output unit 60, the passage hole 72*a* of the facing plate 72 faces the output hole 64*a* (refer to FIG. 6) of the side plate 64, and the detection convex portion 72*e* is inserted into the detection hole 64*e* (refer to FIG. 6). The unit main body portion 70 is provided with a maintenance mechanism (not shown) for maintaining the attached state of the output unit 60 in the attached state of the output unit 60.

Output Plate 76

As illustrated in FIG. 5, the output plate 76 is formed into a plate shape, is disposed between the pair of protruding portions 70*a* in the unit main body portion 70, and is inclined with respect to the horizontal direction. Further, the output plate 76 is formed into a rectangular shape when viewed from a plate thickness direction.

Output Roll 78 and Pressing Roll 82

As illustrated in FIG. 5, the output roll 78 is disposed in the unit main body portion 70 and is provided with a metal shaft 78*a* extending in the apparatus depth direction and plural resin roll portions 78*b* through which the shaft 78*a* penetrates and is disposed spaced apart in the apparatus depth direction. The output roll 78 is further provided with a pair of metal bearings 78*c* disposed at both end portions of the shaft 78*a* in the apparatus depth direction.

The pressing roll 82 is disposed on the upper side of the roll portion 78*b* and is in contact with the roll portion 78*b* in the vertical direction. The pressing roll 82 is integrally formed of a roll portion and a shaft portion with a resin material, is rotatably supported by a support member (not shown) to press the sheet member P sandwiched between the output roll 78 and the pressing roll 82 against the output roll 78 side.

In this configuration, the output roll 78 is rotated by the transmission of a rotational force, and the pressing roll 82 is rotated following the rotation of the output roll 78. Then, the output roll 78 sandwiches the sheet member P output from the apparatus main body 12*a* with the pressing roll 82 to transport, and outputs the sheet member P to the output plate 76.

Charge Removal Brush 86

As illustrated in FIG. 5, the charge removal brush 86 is disposed in the unit main body portion 70, and is on the downstream side of the output roll 78 and the pressing roll 82 in the transport direction of the sheet member P. The charge removal brush 86 is provided with a metal plate material 86*a* and a brush-like metal brush material 86*b*.

The plate material 86*a* extends to the apparatus depth direction, and the plate surface of the plate material 86*a* faces the apparatus width direction. In addition, the plate material 86*a* is formed into a rectangular shape extending to the apparatus depth direction when viewed from the plate thickness direction, and is disposed in the same range as the shaft 78*a* of the output roll 78 in the apparatus depth direction.

The brush material 86*b* protrudes downward from the lower edge of the plate material 86*a* and extends in the vertical direction. In addition, the plural brush materials 86*b* are provided at intervals in the apparatus depth direction.

In this configuration, a part on the end side (=lower end side) of the brush material 86*b* is in contact with the sheet surface of the sheet member P transported by the output roll 78.

Charge Removal Plate 88

The charge removal plate 88 is formed by bending a trimmed sheet metal, and is, as illustrated in FIG. 5, disposed on the back side of the output roll 78 and the charge removal brush 86 in the apparatus depth direction. The charge removal plate 88 is an example of the movement portion.

Figure 3:
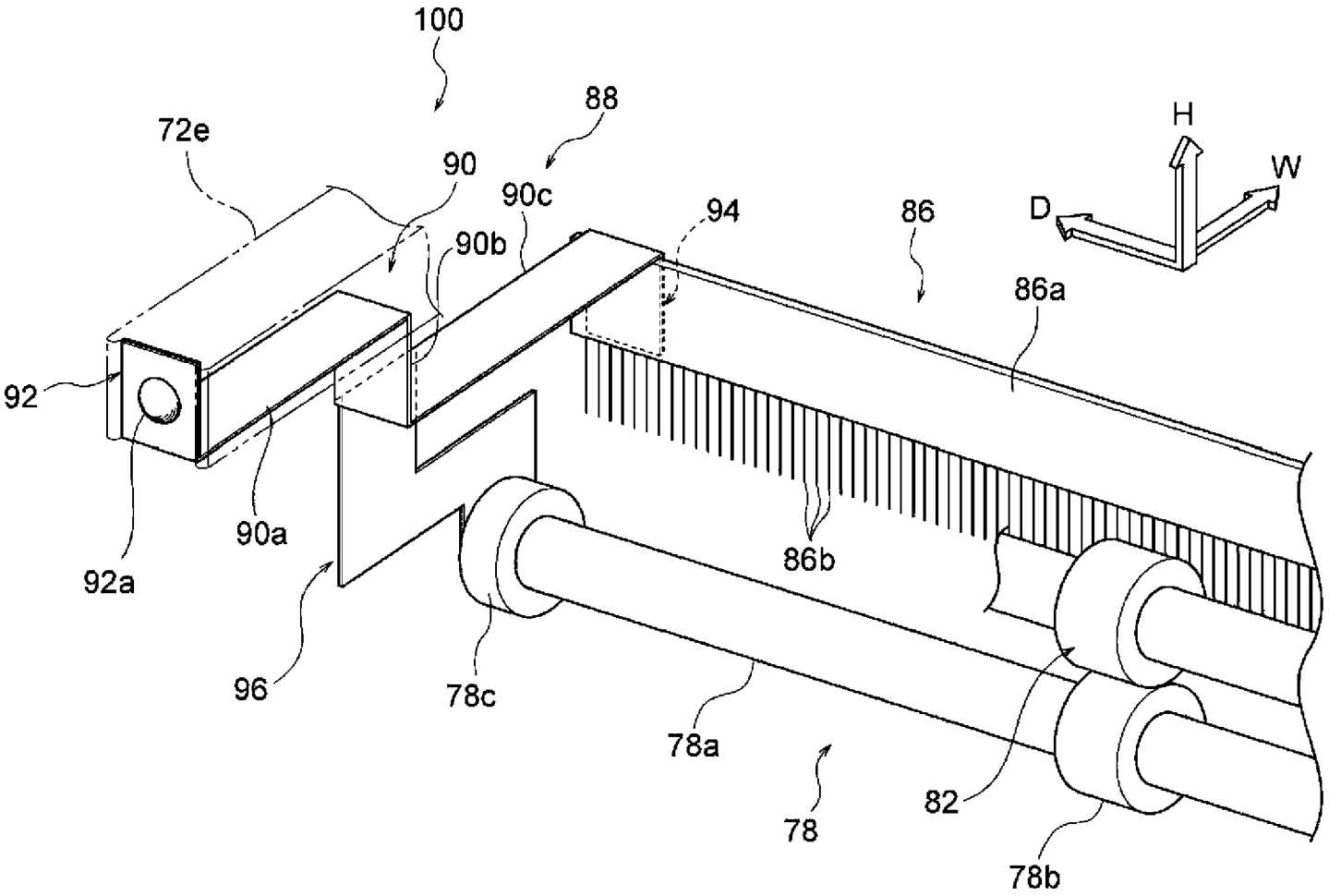
FIG. 3 is a perspective view illustrating a charge removal plate and the like provided in an output unit of the unit attaching/detaching structure according to the exemplary embodiment of the present disclosure.

As illustrated in FIGS. 3 and 5, the charge removal plate 88 is provided with a main body portion 90 extending in the apparatus width direction, and a connecting portion 92 connected to the apparatus main body 12*a* of the main body portion 90. Further, the charge removal plate 88 is provided with a connecting portion 94 connected to a part on the side opposite to the side to which the connecting portion 92 is connected in the main body portion 90 and a connecting portion 96 connected to a part on the central side of the main body portion 90 in the apparatus width direction.

The main body portion 90 is formed into a step shape as viewed from the apparatus depth direction, and is provided with a first portion 90*a*, a second portion 90*b*, and a third portion 90*c*, which are arranged in this order from the apparatus main body 12*a* side. The first portion 90*a* and the third portion 90*c* are formed into a rectangular shape in which the plate surface faces in the vertical direction and extends in the apparatus width direction as viewed from the plate thickness direction. The second portion 90*b* is formed into a rectangular shape in which the plate surface faces in the apparatus width direction and extends in the vertical direction as viewed from the plate thickness direction.

The connecting portion 92 is connected to an edge portion of the first portion 90*a* of the main body portion 90 on the apparatus main body 12*a* side, and protrudes upward from the first portion 90*a*. Further, the connecting portion 92 is formed into a rectangular shape in which the plate surface faces in the apparatus width direction as viewed from the plate thickness direction. In addition, the connecting portion 92 is provided with a protruding portion 92*a* that protrudes in a curved surface shape from the plate surface toward the apparatus main body 12*a*.

Further, as illustrated in FIG. 4, the connecting portion 92 and the first portion 90*a* of the main body portion 90 protrude from the facing plate 72 toward the apparatus main body 12*a*, and the connecting portion 92 is in contact with the end surface 74 of the detection convex portion 72*e* at a surface. In this state, the connecting portion 92 is disposed between the pair of protruding portions 74*a* in the apparatus depth direction, and the protruding end of the protruding portion 92*a* of the connecting portion 92 protrudes toward the apparatus main body 12*a* with respect to the protruding portion 74*a*.

As illustrated in FIGS. 3 and 5, the connecting portion 94 is connected to the edge portion on the side opposite to the apparatus main body 12*a* in the third portion 90*c* of the main body portion 90, and protrudes downward from the third portion 90*c*. Further, the connecting portion 94 is formed into a rectangular shape in which the plate surface faces in the apparatus width direction as viewed from the plate thickness direction. The connecting portion 94 is in contact with a part on the back side in the apparatus depth direction in the plate material 86*a* of the charge removal brush 86 at a surface. In this way, the charge removal plate 88 is electrically connected to the charge removal brush 86.

The connecting portion 96 is connected to the edge portion of the second portion 90*b* of the main body portion 90 on the back side in the apparatus depth direction and protrudes downward from the second portion 90*b*. Further, the connecting portion 96 is formed into a step shape in which the plate surface faces in the apparatus depth direction as viewed from the plate thickness direction. The connecting portion 96 is in contact with one of the bearings 78*c* of the output roll 78. In this way, the charge removal plate 88 is electrically connected to the output roll 78.

Others

As illustrated in FIG. 4, a transmission gear 98 for transferring a rotational force to the output roll 78 is attached to an end portion on the side opposite to the side on which the charge removal plate 88 is disposed in the shaft 78*a* of the output roll 78. In addition, as described above, a portion of the transmission gear 98 protrudes to the outside from the exposure hole 72*d* of the facing plate 72.

In this configuration, in the attached state of the output unit 60, a portion of the transmission gear 98 exposed from the exposure hole 72*d* is inserted into the insertion hole 64*d* (refer to FIG. 6) of the side plate 64, and the transmission gear 98 engages with a drive gear (not shown). With this, the rotational force is transmitted to the output roll 78 via the transmission gear 98 so that the output roll 78 is rotated.

Detection Mechanism 66

The detection mechanism 66 is disposed inside the apparatus main body 12*a* as illustrated in FIG. 1, and is provided with a detection unit 102 and a detection plate 106.

Detection Unit 102

The detection unit 102 is an optical sensor, and is formed into a. U-shaped with the lower side opened as viewed in the apparatus width direction, and is provided with a pair of separated portions 102*a* separated in the apparatus depth direction. With this, a space 104 is formed between the pair of the separated portions 102*a*. In addition, light is emitted from one separated portion 102*a* to the space 104, and the light emitted from the one separated portion 102*a* is incident on other separated portion 102*a*.

Detection Plate 106

The detection plate 106 is formed by bending a trimmed sheet metal, and is provided with, as illustrated in FIG. 1, a displacement portion 108 which is displaced so as to be inserted into and removed from the space 104 and a cantilever-like cantilevered portion 110 extending in the vertical direction and being fixed to the apparatus main body 12*a* at the upper end portion. Further, the detection plate 106 is provided with a strip-like strip portion 114 extending in the apparatus depth direction, having the displacement portion 108 connected to one end and the cantilevered portion 110 connected to the other end. The cantilevered portion 110 is an example of the connecting portion.

In the displacement portion 108, the plate surface is directed in the apparatus width direction, and at least a portion thereof is disposed in the space 104.

The cantilevered portion 110 is disposed apart from the displacement portion 108 in an intersecting direction (corresponding to the apparatus depth direction) which intersects with an attaching/detaching direction (corresponding to the apparatus width direction) of the output unit 60. Specifically, the cantilevered portion 110 is disposed at the back side in the apparatus depth direction with respect to the displacement portion 108, and extends in the vertical direction.

The cantilevered portion 110 is a plate spring and is formed into a step shape as viewed from the apparatus depth direction, and formed into a rectangular shape extending in the vertical direction as viewed from the apparatus width direction. Further, a base portion 110*a* whose plate surface is directed in the apparatus width direction is provided on the upper end part of the cantilevered portion 110, and an end portion 110*b* whose plate surface is directed in the apparatus width direction and is disposed on the side plate 64 side with respect to the base portion 110*a* is provided on the lower end part of the cantilevered portion 110. Note that, a plate spring is a spring using energy absorption by elastic deformation of bending of metal plates such as spring steel, and energy discharge by restoration.

The base portion 110*a* is formed into a rectangular shape as viewed from the plate thickness direction, and is fixed to a metal frame member 120 provided on the apparatus main body 12*a* and grounded, by a metal fixture 122. In this way, the detection plate 106 is attached to the frame member 120 by fixing the base portion 110*a* to the frame member 120. Further, the end portion Hob is formed into a rectangular shape when viewed from a plate thickness direction.

As such, by fixing the base portion 110*a* to the frame member 120, the cantilevered portion 110 extending in the vertical direction is in a cantilever state in which the base portion 110*a* is at the support end and the end portion 110*b* is at the free end. In the cantilever state, one end side of the member is fixed, and the other end side is displaceable freely.

Further, the end portion 110*b* overlaps the detection hole 64*e* formed in the side plate 64 as viewed in the apparatus depth direction.

Figure 2B:
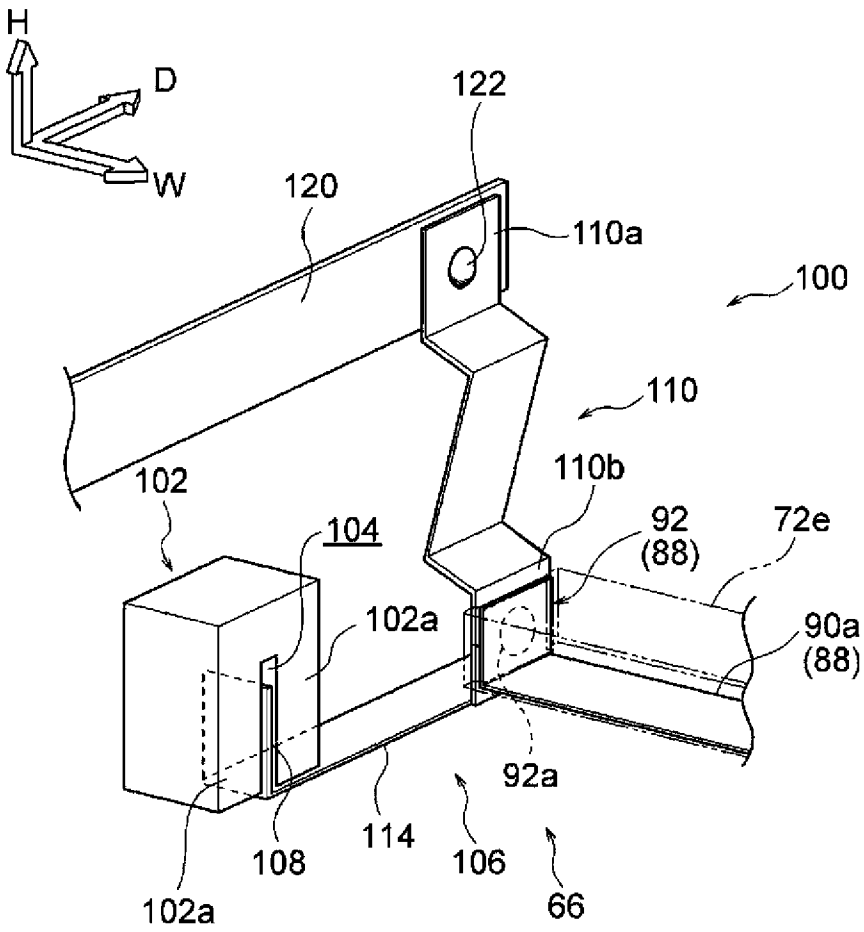
FIGS. 2A and 2B are an enlarged perspective view illustrating the detection unit and the cantilevered portion provided in an apparatus main body of a unit attaching/detaching structure according to an exemplary embodiment of the present disclosure.
Figure 2A:
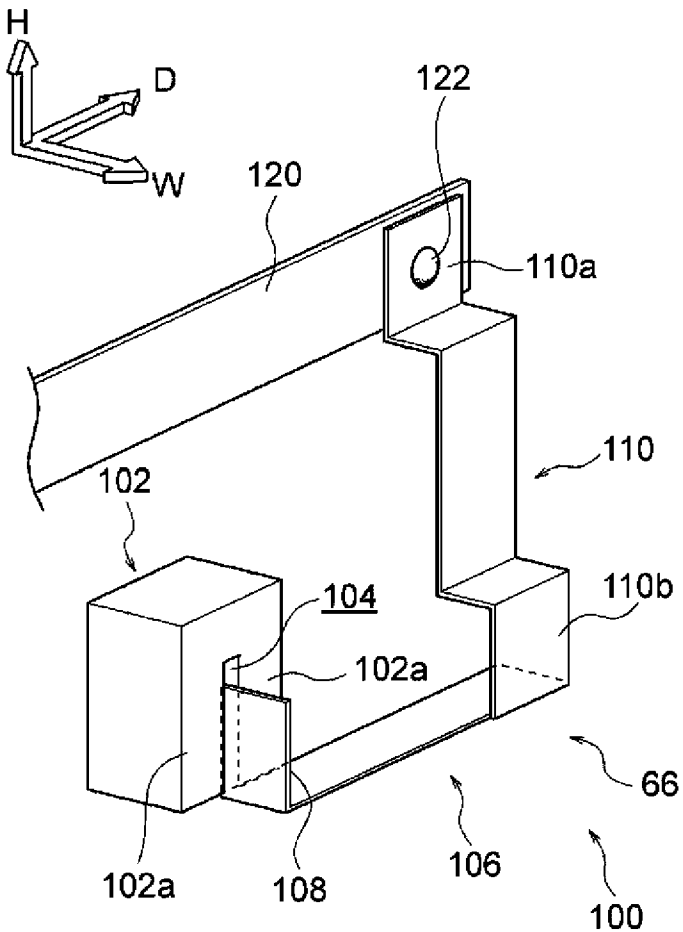

In this configuration, when the output unit 60 is attached to the apparatus main body 12*a* from the state where the output unit 60 is detached from the apparatus main body 12*a* (hereinafter, referred to as the detached state of the output unit 60"), the detection convex portion 72*e* of the output unit 60 is inserted into the detection hole 64*e* of the side plate 64. As illustrated in FIGS. 2A and 2B, the end portion 110*b* of the cantilevered portion 110 comes into contact with the protruding portion 92*a* formed on the connecting portion 92 of the charge removal plate 88 and is pushed by the output unit 60 (refer to FIG. 4) to one side (corresponding to the left side in the drawing) in the apparatus width direction. By pressing the end portion 110*b*, the cantilevered portion 110, which is a plate spring, on the end portion 110*b* side (corresponding to the free end side) moves to one side in the apparatus width direction (corresponding to the left side in the drawing) with the fixed base portion 110*a* so as to be elastically deformed. Further, the contact between the protruding portion 92*a* formed on the connecting portion 92 of the charge removal plate 88 and the end portion 110*b* of the cantilevered portion 110 allows the charge removal plate 88 and the detection plate 106 to be electrically connected to each other.

Further, when the output unit 60 is detached from the attached state of the output unit 60, the end portion 110*b* of the cantilevered portion 110 is separated from the protruding portion 92*a* formed on the connecting portion 92 of the charge removal plate 88. When the end portion 110*b* is separated from the protruding portion 92*a*, the cantilevered portion 110, which is a plate spring on the end portion 110*b* side, moves to the other side in the apparatus width direction (corresponding to the right side in the drawing) to be elastically returned.

As illustrated in FIG. 1, the strip portion 114 is disposed below the detection unit 102 in the vertical direction, and extends from the displacement portion 108 to the end portion 110*b* of the cantilevered portion 110 in the apparatus depth direction. In other words, the strip portion 114 is disposed at a position that does not interfere with the detection unit 102 even if the strip portion 114 moves in the apparatus width direction.

Further, the plate surface of the strip portion 114 is directed in the vertical direction, and the strip portion 114 is formed into a rectangular shape extending in the apparatus depth direction as viewed from the plate thickness direction.

Then, when the end portion 110*b* of the cantilevered portion 110 moves, the displacement portion 108 is displaced in an interlocking manner. That is, the strip portion 114 functions as an interlocking unit that interlocks the displacement portion 108 with the movement of the cantilevered portion 110.

Further, the displacement portion 8 is connected to a part on the one end side of the strip portion 114, and the end portion 110*b* of the cantilevered portion 110 is connected to a part on the other end side of the strip portion 114 so that the cantilevered portion 110 is separated from the detection unit 102 as viewed from the apparatus depth direction. In other words, in the apparatus depth direction, a portion of the strip portion 114 overlaps the detection unit 102, and another portion of the strip portion 114 is disposed at a position different from the detection unit 102.

As described above, the strip portion 114 functions as a separation unit that separates the cantilevered portion 110 and the detection unit 102 from each other when viewed in the apparatus depth direction.

In this configuration, in the detached state of the output unit 60, as illustrated in FIG. 2A, a part on one side of the displacement portion 108 in the apparatus width direction is disposed in the space 104 of the detection unit 102. Then, the light emitted from one of the separated portion 102*a* is incident on the other separated portion 102*a*.

On the other hand, when the output unit 60 is attached to the apparatus main body 12*a* from the detached state of the output unit 60, the detection convex portion 72*e* of the output unit 60 is inserted into the detection hole 64*e* of the side plate 64. As illustrated in FIG. 2B, the end portion 110*b* of the cantilevered portion 110 comes into contact with the protruding portion 92*a* formed on the connecting portion 92 of the charge removal plate 88 and is pushed by the output unit 60 to one side in the apparatus width direction. As a result, the end portion 110*b* moves to one side in the apparatus width direction, and the cantilevered portion 110 is elastically deformed.

The displacement portion 108 is displaced to one side in the apparatus width direction as the end portion 110*b* is moved to one side in the apparatus width direction. Then, most of the displacement portion 108 is disposed in the space 104 of the detection unit 102. With this, the light emitted from one of the separated portion 102*a* is blocked by the displacement portion 108 and is not incident on the other separated portion 102*a*. In this manner, the detection unit 102 detects that the output unit 60 has been attached to the apparatus main body 12*a*.

As described above, the unit attaching/detaching structure 100 includes the output unit 60, the displacement portion 108, the detection unit 102, the cantilevered portion 110, and the charge removal plate 88 and is configured such a the output unit 60 is attachable to and detachable from the apparatus main body 12*a*.

Action of Main Component Configuration

Next, the action of the unit attaching/detaching structure 100 will be described. Specifically, a case where the output unit 60 is attached to the apparatus main body 12*a* from the detached state of the output unit 60 and a case where the output unit 60 is detached from the apparatus main body 12*a* from the attached state of the output unit 60 will be described.

Case where Output Unit 60 is Attached to Apparatus Main Body 12*a*

In the detached state of the output unit 60, as illustrated in FIG. 2A, a part on one side of the displacement portion 108 in the apparatus width direction is disposed in the space 104 of the detection unit 102. With this, the light emitted from one of the separated portion 102*a* is incident on the other separated portion 102*a*. In this manner, the detection unit 102 detects the detached state of the output unit 60.

Further, when the output unit 60 is attached to the apparatus main body La by moving the output unit 60 to one side in the apparatus width direction from the detached state of the output unit 60, the detection convex portion 72*e* (refer to FIG. 4) of the output unit 60 is inserted into the detection hole 64*e* (refer to FIG. 6) of the side plate 64.

When the detection convex portion 72*e* is inserted into the detection hole 64*e*, as illustrated in FIG. 2B, the front end portion 110*b* of the cantilevered portion 110 contacts the protruding portion 92*a* formed on the connecting portion 92 of the charge removal plate 88 and is pushed by the Output unit 60 to one side in the apparatus width direction. As a result, the end portion 110*b* moves to one side in the apparatus width direction, and the cantilevered portion 110 is elastically deformed.

The displacement portion 108 is displaced to one side in the apparatus width direction as the end portion 110*b* is moved to one side in the apparatus width direction. Then, most of the displacement portion 108 is disposed in the space 104 of the detection unit 102. With this, the light emitted from one of the separated portion 102*a* is blocked by the displacement portion 108 and is not incident on the other separated portion 102*a*. In this manner, the detection unit 102 detects that the output unit 60 has been attached to the apparatus main body 12*a*.

Further, in the attached state of the output unit 60, the rotational force is transmitted from the apparatus main body 12*a* side to the output roll 78 via the transmission gear 98, thereby the output roll 78 is rotated. Then, the output roll 78 to be rotated sandwiches the sheet member P output from the apparatus main body 12*a* with the pressing roll 82 to transport, and outputs the sheet member P to the output plate 76 (refer to FIG. 5).

In addition, the brush material 86*h* of the charge removal brush 86 as illustrated in FIG. 5 comes into contact with the sheet surface of the sheet member P transported by the output roll 78, and the charge removal brush 86 discharges the sheet member P.

Here, due to the frictional force generated between the output roll 78 and the sheet member P, the frictional charge generated on the shaft 78*a* of the output roll 78 is suppressed by electrically connecting the charge removal plate 88 and the cantilevered portion 110. Similarly, due to the frictional force generated between the charge removal brush 86 and the sheet member P, the frictional charge generated on the charge removal brush 86 is suppressed by electrically connecting the charge removal plate 88 and the cantilevered portion 110.

Case where Output Unit 60 is Detached from Apparatus Main Body 12*a*

In the attached state of the output unit 60, as illustrated in FIG. 2B, most of the displacement portion 108 is disposed in the space 104 of the detection unit 102.

Further, when the output unit 60 is detached from the apparatus main body 12*a* by moving the output unit 60 to the other side in the apparatus width direction from the attached state of the output unit 60, the detection convex portion 72*e* (refer to FIG. 4) of the output unit 60 is removed from the detection hole 64*e* (refer to FIG. 6) of the side plate 64.

When the detection convex portion 72*e* is removed from the detection hole 64*e*, the end portion 110*b* of the cantilevered portion 110 is separated from the protruding portion 92*a* formed in the connecting portion 92 of the charge removal plate 88. When the end portion 110*b* of the cantilevered portion 110 is separated from the connecting portion 92 of the charge removal plate 88, as illustrated in FIG. 2A, the end portion 110*b* moves to the other side in the apparatus width direction so that the cantilevered portion 110 is elastically returned.

The displacement portion 108 is displaced to the other side in the apparatus width direction as the end portion 110*b* is moved to the other side in the apparatus width direction. Then, a part on one side of the displacement portion 108 in the apparatus width direction is disposed in the space 104 of the detection unit 102. With this, the light emitted from one of the separated portion 102*a* is incident on the other separated portion 102*a*. In this manner, the detection unit 102 detects that the output unit 60 has been detached from the apparatus main body 12*a*.

SUMMARY

As described above, when the output unit 60 is attached to the apparatus main body 12*a*, the cantilevered portion 110 in contact with the charge removal plate 88 of the output unit 60 is separated from the detection unit 102 in the apparatus depth direction. Therefore, damage to the detection unit 102 is suppressed when the output unit 60 is attached to the apparatus main body 12*a*, as compared with the case where the charge removal plate directly displaces the displacement portion 108.

The cantilevered portion 110 is a plate spring, and when the output unit 60 is attached to the apparatus main body 12*a*, the cantilevered portion 110 comes into contact with the charge removal plate 88 and is pressed to be elastically deformed. On the other hand, when the output unit 60 is detached from the apparatus main body 12*a*, the cantilevered portion 110 is separated from the charge removal plate 88 to be elastically returned. In this way, by using the cantilevered portion 110 as a plate spring, for example, the cantilevered portion 110 is moved with a simple configuration as compared with the case where the cantilevered portion is moved to one side and the other side using an actuator.

Further, the cantilevered portion 110 is in a cantilever state, and the free end side of the cantilevered portion 110 is connected to the displacement portion 108 via the strip portion 114. For this reason, the cantilevered portion 110 is miniaturized as compared with the case where the support end side of the cantilevered portion is connected to the displacement portion.

Further, the contact between the charge removal plate 88 of the output unit 60 and the cantilevered portion 110 allows the cantilevered portion 110 to be electrically connected to the apparatus main body 12*a*. As a result, the number of parts is reduced as compared with the case where members for electrically connecting the cantilevered portion to the apparatus main body 12*a* are separately provided.

The output roll 78 and the charge removal brush 86 are electrically connected to the apparatus main body 12*a* so that the output roll 78 and the charge removal brush 86 are grounded. As a result, the number of parts is reduced as compared with the case where the members for grounding the output roll 78 and the charge removal brush 86 are separately provided.

Further, in the image forming system 10, the attached state of the output unit 60 is detected with high accuracy by suppressing the damage of the detection unit 102 as compared with the case where the charge removal plate directly displaces the displacement portion 108.

Note that the present disclosure has been described in detail with respect to the specific exemplary embodiment; however, it is clear for the person skilled in the art that the present disclosure is not limited to the exemplary embodiment, and various other exemplary embodiments can be employed within the scope of the present disclosure. In the above exemplary embodiment, the cantilevered portion 110 and the displacement portion 108 are separated from each other in the apparatus depth direction; however, the direction may be the intersecting direction which intersects with the attaching/detaching direction corresponding to the apparatus width direction) of the output unit 60, for example, it may be the vertical direction.

Further, in the above exemplary embodiment, a transmissive optical sensor is used as the detection unit 102; however, a reflective optical sensor may be used, or a mechanical sensor or the like that mechanically detects the displacement of the displacement portion 108 may be used.

Further, in the above exemplary embodiment, the output roll 78 and the charge removal brush 86 are grounded by the contact between the charge removal plate 88 of the output unit 60 and the cantilevered portion 110; however, when the charge removal plate 88 and the cantilevered portion 110 come into contact with each other, for example, power may be supplied to a member provided in the output unit, or an electrical signal may flow.

In the above exemplary embodiment, the cantilevered portion 110 is a plate spring; however, it may be a member that moves by being pushed by the output unit 60, and may be, for example, a rubber member that expands and contracts in the apparatus width direction.

Further, although not particularly described in the above exemplary embodiment, for example, the cantilevered portion may include a combination of a plate material and a compression spring.

Further, although not particularly described in the above exemplary embodiment, the displacement portion 108 may be a member constituting the detection unit 102.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A unit attaching/detaching structure, comprising:

a unit that is attachable to and detachable from an apparatus main body;

a displacement portion that is provided on the apparatus main body and is displaceable to one side and another side;

a detection unit that detects attachment of the unit when the displacement portion is displaced from the another side to the one side;

a connecting portion that is separated from the detection unit in a direction intersecting with a direction of attaching/detaching of the unit, and is connected to the displacement portion so as to displace the displacement portion to be moved;

a movement portion that is provided on the unit and displaces the displacement portion from the another side to the one side by moving the connecting portion when the unit is attached to the apparatus main body; and the connection portion comprising a returning unit that returns the displacement portion from the one side to the another side when the unit is detached from the apparatus main body, wherein the displacement portion is displaced toward the detection unit when the unit is attached to the apparatus main body.

2. An image forming system comprising:

an image forming apparatus that forms an image on a recording medium; and the unit that is attachable to and detachable from a main body of the image forming apparatus by the unit attaching/detaching structure according to claim 1 and to which the recording medium is output from the apparatus main body while the unit is attached to the apparatus main body.

3. A unit attaching/detaching structure, comprising:

a unit that is attachable to and detachable from an apparatus main body;

a displacement portion that is provided on the apparatus main body and is displaceable to one side and another side;

a detection unit that detects attachment of the unit when the displacement portion is displaced from the another side to the one side;

a connecting portion that is separated from the detection unit in a direction intersecting with a direction of attaching/detaching of the unit, and is connected to the displacement portion so as to displace the displacement portion to be moved;

a movement portion that is provided on the unit and displaces the displacement portion from the another side to the one side by moving the connecting portion when the unit is attached to the apparatus main body; and the connection portion comprising a returning unit that returns the displacement portion from the one side to the another side when the unit is detached from the apparatus main body, wherein the connecting portion is formed of a plate spring as the returning unit, comes into contact with the movement portion and elastically deformed by being pressed against the movement portion when the unit is attached to the apparatus main body, and is separated from the movement portion and elastically returned when the unit is detached from the apparatus main body.

4. The unit attaching/detaching structure according to claim 3, wherein the connecting portion is in a cantilever state, and a free end side of the connecting portion is connected to the displacement portion.

5. A unit attaching/detaching structure, comprising:

a unit that is attachable to and detachable from an apparatus main body;

a displacement portion that is provided on the apparatus main body and is displaceable to one side and another side;

a detection unit that detects attachment of the unit when the displacement portion is displaced from the another side to the one side;

a connecting portion that is separated from the detection unit in a direction intersecting with a direction of attaching/detaching of the unit, and is connected to the displacement portion so as to displace the displacement portion to be moved;

a movement portion that is provided on the unit and displaces the displacement portion from the another side to the one side by moving the connecting portion when the unit is attached to the apparatus main body; and the connection portion comprising a returning unit that returns the displacement portion from the one side to the another side when the unit is detached from the apparatus main body, wherein when the movement portion and the connecting portion come into contact with each other, the connecting portion is electrically connected to the apparatus main body.

6. The unit attaching/detaching structure according to claim 5, wherein the apparatus main body is a main body of an image forming apparatus that forms an image on a recording medium, the unit is a unit to which the recording medium is output from the apparatus main body, and includes a transport unit that transports the recording medium while rotating, and when the movement portion and the connecting portion come into contact with each other, the transport unit is grounded.

* * * * *